US005784820A

United States Patent [19]

Wood

[11] Patent Number: 5,784,820

[45] Date of Patent: Jul. 28, 1998

[54] ARM STABILIZER

[76] Inventor: Kenneth C. Wood, R.R. 2 Box 228, Mouth of Wilson, Va. 24363

[21] Appl. No.: 821,210

[22] Filed: Mar. 20, 1997

[51] Int. Cl.[6] ..... F41C 27/00

[52] U.S. Cl. ..... 42/94

[58] Field of Search ..... 42/94; 403/109, 403/377, DIG. 9

[56] References Cited

U.S. PATENT DOCUMENTS

| | | | |
|---|---|---|---|
| 454,300 | 6/1891 | Sproul | 42/94 |
| 759,593 | 5/1904 | Cover | 42/94 |
| 915,481 | 3/1909 | Roop | 42/94 |
| 1,103,824 | 7/1914 | Page | 42/94 |
| 2,463,107 | 3/1949 | Holroyd | 42/85 |
| 3,200,528 | 8/1965 | Christensen | 42/94 |
| 3,390,477 | 7/1968 | Galbraith | 42/94 |
| 3,473,833 | 10/1969 | Garrette, Jr. et al. | 403/109 |
| 3,553,878 | 1/1971 | Canon | 42/94 |
| 3,867,055 | 2/1975 | Wooden | 403/373 |
| 4,515,301 | 5/1985 | A'Costa | 224/204 |
| 4,575,964 | 3/1986 | Griffin | 42/94 |
| 4,844,390 | 7/1989 | Duke | 248/118 |
| 5,111,983 | 5/1992 | Simmons et al. | 224/258 |
| 5,351,867 | 10/1994 | Vest | 224/224 |
| 5,528,846 | 6/1996 | Baggett | 42/94 |

*Primary Examiner*—Charles T. Jordan
*Assistant Examiner*—Meena Chelliah

[57] ABSTRACT

A new Arm Stabilizer for stabilizing a hunter's arm while using a firearm or a bow. The inventive device includes a hip support member, a telescoping support member extending from the hip support member, and an arm support member rotatably attached to the telescoping support member opposite the hip support member for supporting an extended arm of the user. The telescoping support member provides for selective adjustment of the arm support member along a continuum of positions. The telescoping support member comprises a sleeve member, an extension member matingly coupled within the sleeve member and being selectively and adjustably extendable outward from the sleeve member, and an extension locking means for locking the extension member in a selected position along the continuum of positions. The arm support member has U-shaped portion designed to receive and support the extended arm of the user. The hip support member includes a fastening means for fastening the invention to the belt of the user. The fastening means allows the invention to hang from the belt of the user when not in use.

9 Claims, 3 Drawing Sheets

20
27
29
28
24
26

40
60
48
46
45
42
66
44
68
61

ARM STABILIZER

BACKGROUND OF THE INVENTION

1. Field of the Invention

The present invention relates to stabilizing devices and more particularly pertains to a new Arm Stabilizer for stabilizing a hunter's arm while using a firearm or a bow.

2. Description of the Prior Art

The use of stabilizing devices is known in the prior art. More specifically, stabilizing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art stabilizing devices include U.S. Pat. No. 4,844,390; U.S. Pat. No. 5,351,867; U.S. Pat. No. D314,287; U.S. Pat. No. 5,111,983; U.S. Pat. No. 4,515,301 and U.S. Pat. No. 5,060,409.

While these devices fulfill their respective, particular objectives and requirements, the aforementioned patents do not disclose a new Arm Stabilizer. The inventive device includes a hip support member, a telescoping support member extending from the hip support member, and an arm support member rotatably attached to the telescoping support member opposite the hip support member.

In these respects, the Arm Stabilizer according to the present invention substantially departs from the conventional concepts and designs of the prior art, and in so doing provides an apparatus primarily developed for the purpose of stabilizing a hunter's arm while using a firearm or a bow.

SUMMARY OF THE INVENTION

In view of the foregoing disadvantages inherent in the known types of stabilizing devices now present in the prior art, the present invention provides a new Arm Stabilizer construction wherein the same can be utilized for stabilizing a hunter's arm while using a firearm or a bow.

The general purpose of the present invention, which will be described subsequently in greater detail, is to provide a new Arm Stabilizer apparatus and method which has many of the advantages of the stabilizing devices mentioned heretofore and many novel features that result in a new Arm Stabilizer which is not anticipated, rendered obvious, suggested, or even implied by any of the prior art stabilizing devices, either alone or in any combination thereof.

To attain this, the present invention generally comprises a hip support member, a telescoping support member extending from the hip support member, and an arm support member rotatably attached to the telescoping support member opposite the hip support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Arm Stabilizer apparatus and method which has many of the advantages of the stabilizing devices mentioned heretofore and many novel features that result in a new Arm Stabilizer which is not anticipated, rendered obvious, suggested, or even implied by any of the prior art stabilizing devices, either alone or in any combination thereof.

It is another object of the present invention to provide a new Arm Stabilizer which may be easily and efficiently manufactured and marketed.

It is a further object of the present invention to provide a new Arm Stabilizer which is of a durable and reliable construction.

An even further object of the present invention is to provide a new Arm Stabilizer which is susceptible of a low cost of manufacture with regard to both materials and labor, and which accordingly is then susceptible of low prices of sale to the consuming public, thereby making such Arm Stabilizer economically available to the buying public.

Still yet another object of the present invention is to provide a new Arm Stabilizer which provides in the apparatuses and methods of the prior art some of the advantages thereof, while simultaneously overcoming some of the disadvantages normally associated therewith.

Still another object of the present invention is to provide a new Arm Stabilizer for stabilizing a hunter's arm while using a firearm or a bow.

Yet another object of the present invention is to provide a new Arm Stabilizer which includes a hip support member, a telescoping support member extending from the hip support member, and an arm support member rotatably attached to the telescoping support member opposite the hip support member.

Even still another object of the present invention is to provide a new Arm Stabilizer which can be used while sitting or standing as well as while on horseback.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

FIG. ;is an enlarged illustration of the detachable securing means of the present invention.

Figure 2:
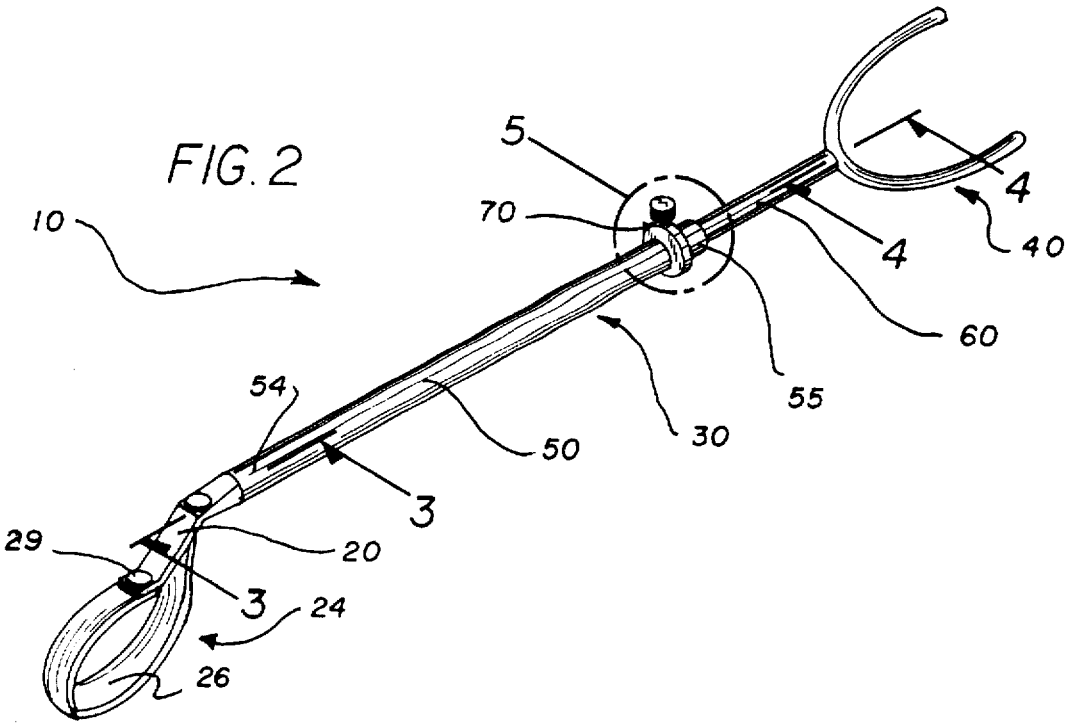
FIG. 2 is an isometric illustration of the present invention.
Figure 4:
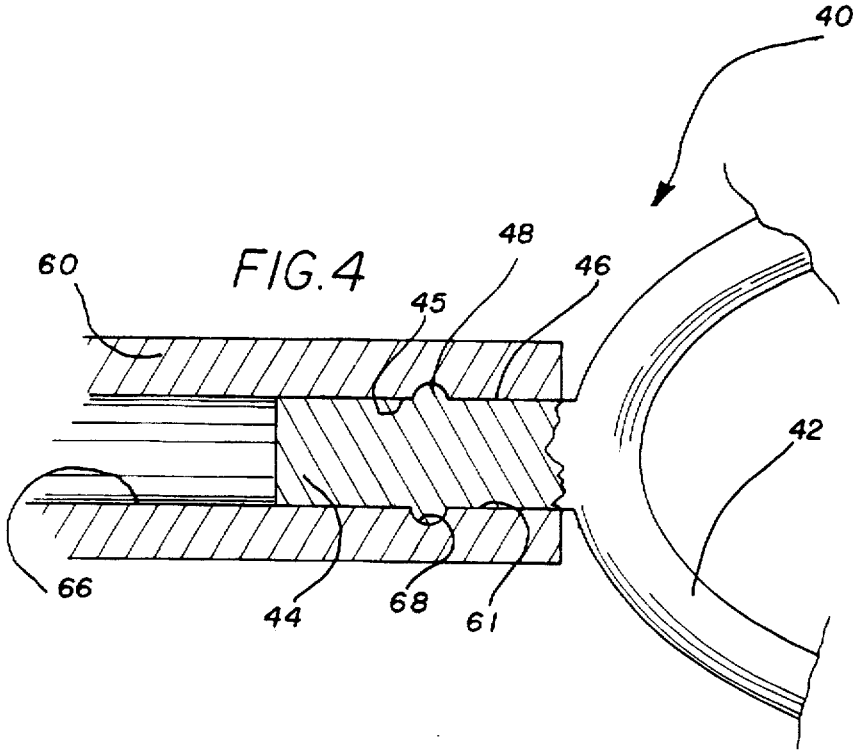

FIG. 4 is a cross sectional view taken along line 4—4 of FIG. 2.

Figure 5:
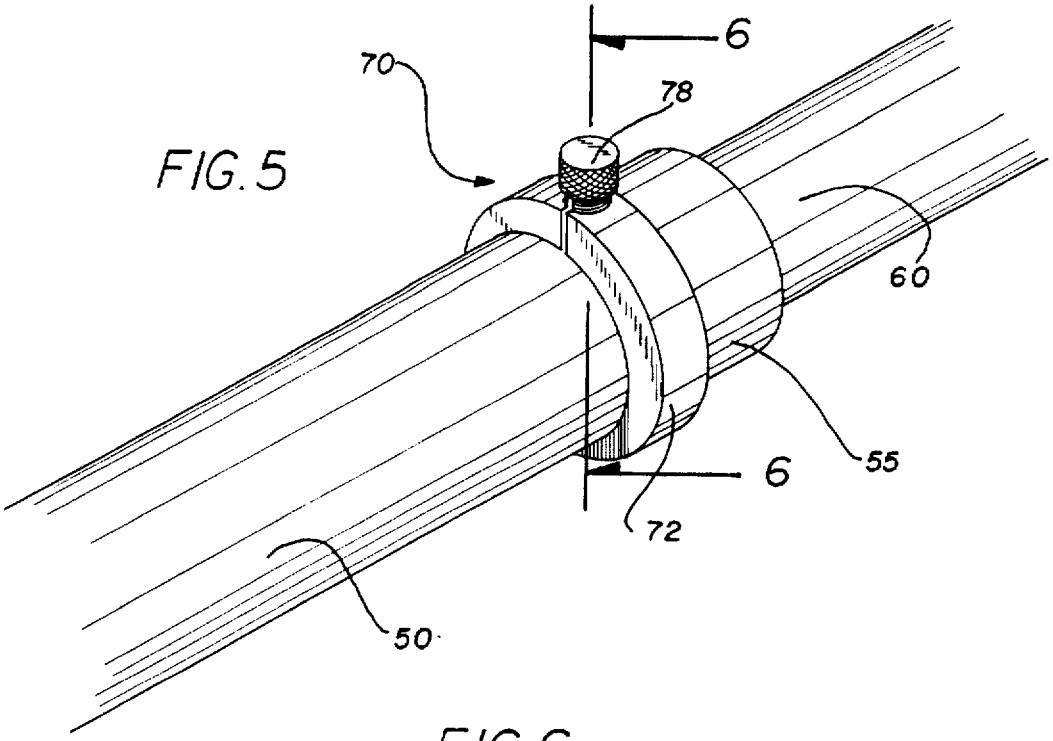

FIG. 5 is an enlarged illustration of the extension locking means of the present invention.

Figure 6:
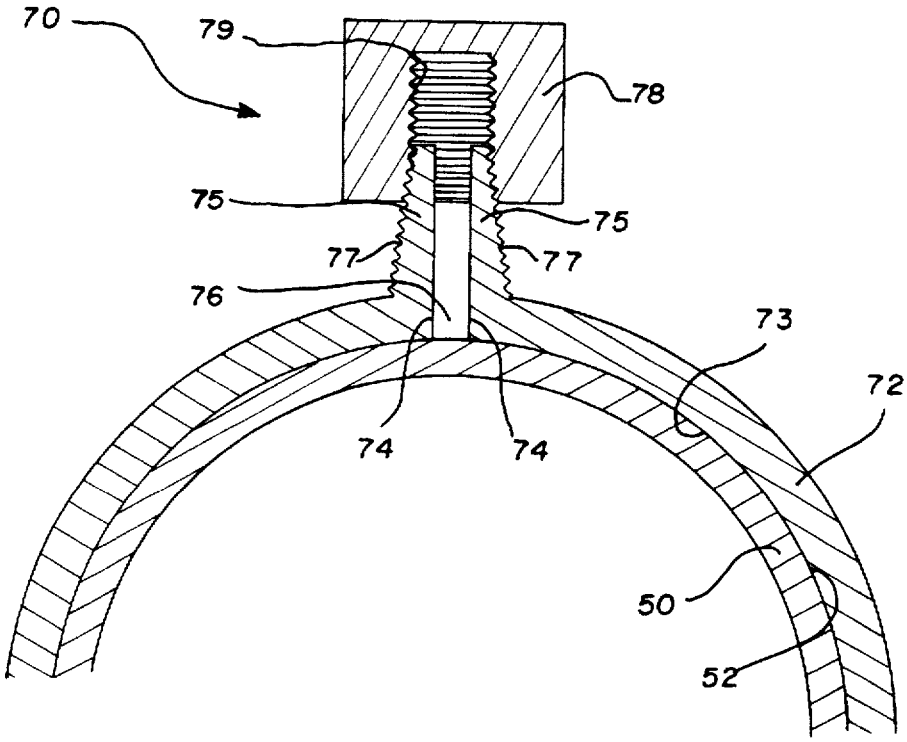

FIG. 6 is a cross sectional view taken along line 6—6 of FIG. 5.

DESCRIPTION OF THE PREFERRED EMBODIMENT

With reference now to the drawings, and in particular to FIGS. 1 through 6 thereof, a new Arm Stabilizer embodying the principles and concepts of the present invention and generally designated by the reference numeral 10 will be described.

More specifically, it will be noted that the Arm Stabilizer 10 comprises a hip support member 20, a telescoping support member 30 extending from the hip support member 20, and an arm support member 40 rotatably attached to the telescoping support member 30 opposite the hip support member 20 for supporting an extended arm of the user. The telescoping support member 30 provides for selective adjustment of the arm support member 40 along a continuum of positions.

Figure 3:
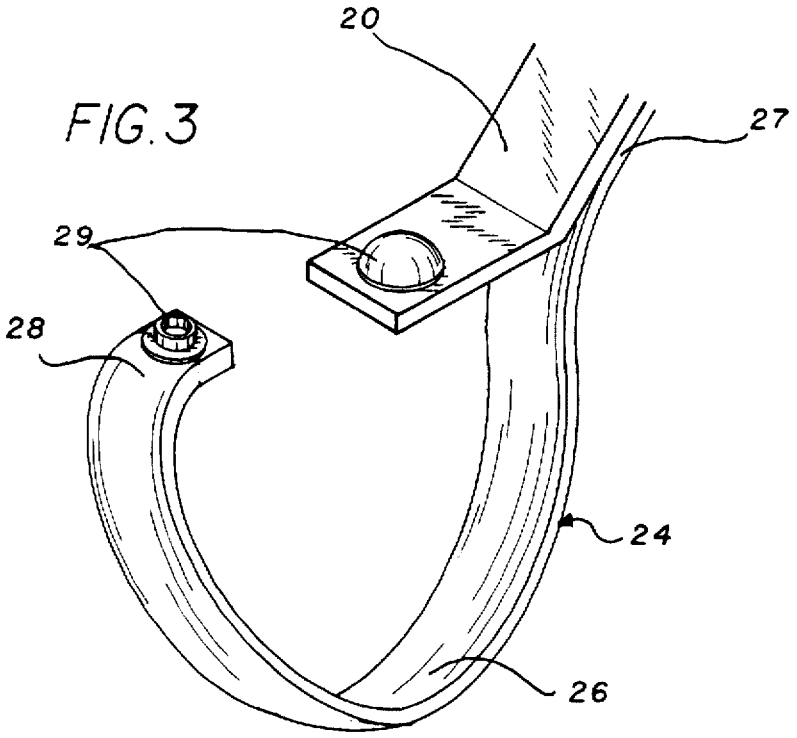

The hip support member 20 includes a fastening means 24 attached to the hip support member 20 for fastening the Arm Stabilizer 10 to a belt 2 of the user thereof. The fastening means 24 allows the invention to hang from the belt 2 of the user when not in use. As best illustrated in FIG. 3, it can be shown that the fastening means 24 comprises a strap 26 having a first end 27 and a second end 28. The first end 27 is attached to the hip support member 20 and a fastener 29 fastens the second end 28 of the strap 26 to the hip support member 20.

The telescoping support member 30 comprises a sleeve member 50 having a first end 54 attached to the hip support member 20 and a second end 55, an extension member 60 matingly coupled within the sleeve member 50 and being selectively and adjustably extendable outward from the second end 55 of the sleeve member 50, and an extension locking means 70 for locking the extension member 60 in a selected position along the continuum of positions. As best illustrated in FIGS. 5 and 6, it can be shown that the extension locking means 70 comprises a compression band 72 coupled around the sleeve member 50 near the second end 55 and a thumb screw 78 for compressing and tightening the compression band 72 around the sleeve member 50 thereby compressing and tightening the second end 55 of the sleeve member 50 around the extension member 60. The compression band 72 has an inner diameter 73 less than the outer diameter 52 of the sleeve member 50 and has opposed ends 74 with perpendicularly projecting portions 75 having external threads 77 which threadingly mate with internal threads 79 of the thumb screw 78. The perpendicularly projecting portions 75 are provided in spaced relation and define a spaced region 76 which decreases when the thumb screw 78 is tightened.

As best illustrated in FIG. 4, it can be shown that the arm support member 40 comprises a coupling portion 44 and a U-shaped portion 42 extending from one end of the coupling portion 44. The coupling portion 44 has an outer diameter 45 slightly less than an inner diameter 61 of the extension member 60. The coupling portion 44 matingly couples the arm support member 40 to the extension member 60 and allows for coupling rotation of the arm support member 40 relative to the extension member 60. The coupling portion 44 has a rib 48 provided on an outer surface 46 thereof. The rib 48 matingly engages a groove 68 provided in an inner surface 66 of the extension member 60 and provides for coupling rotation and retention of the arm support member 40 within the extension member 60.

Figure 1:
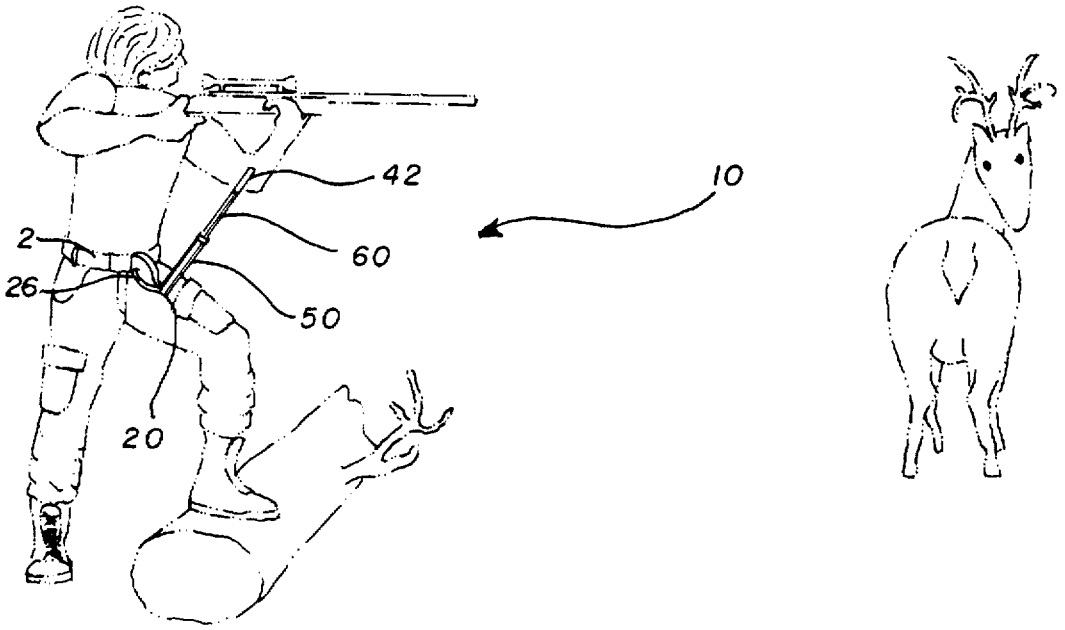
FIG. 1 is an illustration of one application of a new Arm Stabilizer according to the present invention.

In use, the strap 26 is looped around and fastened to the belt 2 of the user of the invention by the snap fastener 29. As best illustrated in FIG. 1, it can be shown that the hip support member 20 is rested against the hip of the user and the extension member 60 is extended outward to a selected position along the continuum of possible positions. The extension member 60 is extended such that the U-shaped portion 42 of the arm support member 40 provides support for the extended arm of the user of the invention. The thumb screw 78 is tightened to lock the extension member 60 in the selected position. When not in use, the invention hangs from the belt 2 of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. An arm stabilizer comprising:

a hip support member;

a telescoping support member extending from said hip support member, wherein said telescoping support member includes sleeve member having a first end and a second end, said first end attached to said hip support member, an extension member matingly coupled within said sleeve member and selectively and adjustably extendable outward from said second end of said sleeve member, and an extension locking means for locking said extension member in a selected position along said continuum of positions;

an arm support member rotatably attached to said telescoping support member opposite said hip support member for supporting an extended arm of a user of the arm stabilizer, said telescoping support member providing for selective adjustment of said arm support member along a continuum of positions;

a thumb screw having internal threads; and a compression band coupled around said sleeve member near said second end, said compression band having an inner diameter less than an outer diameter of said sleeve member and having opposed ends with perpendicularly projecting portions, said perpendicularly projecting portions having external threads which threadingly mate with said internal threads of said thumb screw, said perpendicularly projecting portions provided in spaced relation and defining a spaced region which decreases when said thumb screw is tightened thereby compressing and tightening said compression band around said sleeve member and thereby compressing and tightening said second end of said sleeve member around said extension member.

2. The arm stabilizer of claim 1, wherein said arm support member comprises:

a coupling portion having an outer diameter slightly less than an inner diameter of said telescoping support member, said coupling portion positioned within said telescoping support member and matingly coupling said arm support member and said telescoping support member, said coupling portion allowing for rotation of said arm support member relative to said telescoping support member; and a U-shaped portion attached to one end of said coupling portion and extending beyond said telescoping support member, said U-shaped portion designed to receive and support an extended arm of a user of the arm stabilizer.

3. The Arm stabilizer of claim 2, wherein said coupling portion has a rib on an outer surface thereof, said rib matingly engaging a groove in an inner surface of said telescoping support member and providing for coupling rotation and retention of said arm support member within said telescoping support member.

4. The Arm stabilizer of claim 1, further comprising a fastening means attached to said hip support member for fastening the arm stabilizer to a belt of the user thereof.

5. The Arm stabilizer of claim 4, wherein said fastening means comprises:

a strap having a first end and a second end, said first end attached to said hip support member; and a fastener, said fastener fastening said second end of said strap to said hip support member.

6. The arm stabilizer of claim 3, further comprising a fastening means attached to said hip support member for fastening the arm stabilizer to a belt of the user of said arm stabilizer.

7. The arm stabilizer of claim 6, wherein said fastening means comprises:

a strap having a first end and a second end, said first end attached to said hip support member; and a fastener, said fastener fastening said second end of said strap to said hip support member.

8. An arm stabilizer comprising:

a hip support member;

a telescoping support member extending from said hip support member; and an arm support member rotatably attached to said telescoping support member opposite said hip support member for supporting an extended arm of a user of the arm stabilizer, said telescoping support member providing for selective adjustment of said arm support member along a continuum of positions;

wherein said arm support member includes a coupling portion having an outer diameter slightly less than an inner diameter of said telescoping support member, said coupling portion positioned within said telescoping support member and matingly coupling said arm support member and said telescoping support member, said coupling portion allowing for rotation of said arm support member relative to said telescoping support member;

wherein said arm support further includes a U-shaped portion attached to one end of said coupling portion and extending beyond said telescoping support member, said U-shaped portion designed to receive and support an extended arm of a user of the arm stabilizer; and wherein said coupling portion has a rib on an outer surface thereof, said rib matingly engaging a groove in an inner surface of said telescoping support member and providing for coupling rotation and retention of said arm support member within said telescoping support member.

9. An arm stabilizer comprising:

a hip support member;

a telescoping support member extending from said hip support member; and an arm support member rotatably attached to said telescoping support member opposite said hip support member for supporting an extended arm of a user of the arm stabilizer, said telescoping support member providing for selective adjustment of said arm support member along a continuum of positions;

wherein said arm support member includes a coupling portion having an outer diameter slightly less than an inner diameter of said telescoping support member, said coupling portion positioned within said telescoping support member and matingly coupling said arm support member and said telescoping support member, said coupling portion allowing for rotation of said arm support member relative to said telescoping support member;

wherein said arm support further includes a U-shaped portion attached to one end of said coupling portion and extending beyond said telescoping support member, said U-shaped portion designed to receive and support an extended arm of a user of the arm stabilizer.

* * * * *